US010851681B2

(12) United States Patent
VanWingerden et al.

(10) Patent No.: US 10,851,681 B2
(45) Date of Patent: Dec. 1, 2020

(54) VARIABLE VALVE ACTUATION SYSTEM FOR TYPE II VALVERAIN USING LOST MOTION AND RESET

(71) Applicant: Eaton Intelligent Power Limited, Dublin (IE)

(72) Inventors: Mark VanWingerden, Battle Creek, MI (US); Eric Yankovic, Augusta, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/250,420

(22) Filed: Jan. 17, 2019

(65) Prior Publication Data

US 2019/0145288 A1 May 16, 2019

Related U.S. Application Data

(63) Continuation of application No. PCT/US2017/042973, filed on Jul. 20, 2017.
(Continued)

(51) Int. Cl.
*F01L 1/34* (2006.01)
*F01L 1/24* (2006.01)
(Continued)

(52) U.S. Cl.
CPC ..... *F01L 1/2405* (2013.01); *F01L 1/18* (2013.01); *F01L 1/20* (2013.01); *F01L 1/24* (2013.01);
(Continued)

(58) Field of Classification Search
CPC ... F01L 1/18; F01L 1/2405; F01L 1/20; F01L 1/24; F01L 13/00; F01L 13/06; F01L 13/065; F01L 2800/19
(Continued)

(56) References Cited

U.S. PATENT DOCUMENTS 6,334,429 B1 1/2002 Little, Jr.
6,439,195 B1 8/2002 Warner
(Continued)

FOREIGN PATENT DOCUMENTS

EP 1662098 A1 5/2006
EP 2843203 A1 3/2015
(Continued)

OTHER PUBLICATIONS

International Search Report and Written Opinion for International Application No. PCT/US2017/042973 dated Sep. 29, 2017, 12 pages.
(Continued)

*Primary Examiner* — Zelalem Eshete
(74) *Attorney, Agent, or Firm* — RMCK Law Group PLC

(57) ABSTRACT

A rocker arm assembly for a Type II valvetrain arranged for cooperation with a cylinder head includes a roller finger follower (RFF) and a lost motion with reset (LMR) hydraulic assembly. The RFF has a first end and a second end. The first end cooperates with a valve. The LMR hydraulic assembly has a hydraulic control element and a plunger. The LMR hydraulic assembly moves the plunger between a rigid position and a non-rigid position. The LMR hydraulic assembly is configured at the second end of the RFF.

18 Claims, 9 Drawing Sheets

Related U.S. Application Data

(60) Provisional application No. 62/364,481, filed on Jul. 20, 2016.

(51) Int. Cl.

| | |
|---|---|
| ***F01L 1/18*** | (2006.01) |
| ***F01L 13/06*** | (2006.01) |
| ***F01L 1/20*** | (2006.01) |
| ***F01L 13/00*** | (2006.01) |

(52) U.S. Cl.
CPC ..... *F01L 13/00* (2013.01); *F01L 13/06* (2013.01); *F01L 13/065* (2013.01); *F01L 2800/19* (2013.01)

(58) Field of Classification Search
USPC ..... 123/90.39, 90.44
See application file for complete search history.

(56) References Cited

U.S. PATENT DOCUMENTS

| | | | | |
|---|---|---|---|---|
| 9,038,586 | B2 * | 5/2015 | Schultheis | F01L 1/185 123/90.39 |
| 2003/0172889 | A1 | 9/2003 | Djordjevic | |
| 2007/0204818 | A1 | 9/2007 | Dingle | |
| 2010/0059006 | A1 | 3/2010 | Maehara | |

FOREIGN PATENT DOCUMENTS

| | | | |
|---|---|---|---|
| JP | H04284110 | A | 10/1992 |
| JP | H11247635 | A | 9/1999 |

OTHER PUBLICATIONS

European Search Report for EP Application No. 17831844.0 dated Feb. 24, 2020.

* cited by examiner

VARIABLE VALVE ACTUATION SYSTEM FOR TYPE II VALVERAIN USING LOST MOTION AND RESET

CROSS-REFERENCE TO RELATED APPLICATIONS

This application is a continuation of International Application No. PCT/US2017/042973 filed Jul. 20, 2017, which claims the benefit of U.S. Provisional Patent Application No. 62/364,481, filed Jul. 20, 2016, the disclosure of which is incorporated herein by reference.

FIELD

The present disclosure relates generally to a rocker arm assembly for use in a valve train assembly and more particularly to a hydraulic lash adjuster configuration having controlled collapsing used as a reset function configured on a Type II valvetrain.

BACKGROUND

Decompression engine brakes can be used as auxiliary brakes, in addition to wheel brakes, on relatively large vehicles, for example trucks, powered by heavy or medium duty diesel engines. A decompression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A rocker arm assembly for a Type II valvetrain arranged for cooperation with a cylinder head includes a roller finger follower (RFF) and a lost motion with reset (LMR) hydraulic assembly. The RFF has a first end and a second end. The first end cooperates with a valve. The LMR hydraulic assembly has a hydraulic control element and a plunger. The LMR hydraulic assembly moves the plunger between a rigid position and a non-rigid position. The LMR hydraulic assembly is configured at the second end of the RFF.

The rocker arm assembly can further comprise an accumulator. The hydraulic control element selectively passes oil to the accumulator. The hydraulic control element further includes a spool valve that connects oil volume to a vented dump. A reset pin contacts the RFF and controls the spool valve to connect oil volume to the vented dump. A biasing member biases the RFF toward a cam.

According to additional features, the rocker arm assembly can further include a roller bearing that is positioned generally intermediate the first end of the RFF and the second end of the RFF. A hydraulic lash adjuster (HLA) can be positioned at the first end to accommodate lash between the RFF and a valve. The rocker arm assembly provides variable valve assembly functions including engine brake, early exhaust valve opening (EEVO) and late intake valve closing (LIVC). The LMR hydraulic assembly is accommodated in the cylinder head. The LMR hydraulic assembly is in the form of an LMR capsule.

A rocker arm assembly for a Type II valvetrain arranged for cooperation with a cylinder head according to another example of the present disclosure includes a roller finger follower (RFF) and a lost motion with reset (LMR) hydraulic assembly. The RFF has a first end and a second end. The first end cooperates with a valve. The LMR hydraulic assembly has a plunger assembly and a shuttle assembly. The plunger assembly has a plunger that selectively translates within a plunger chamber between an extended rigid position based upon the plunger chamber being pressurized with oil and a retracted non-rigid position based upon the plunger chamber being depressurized. The plunger, through the RFF, moves the engine valve toward an open position. The shuttle assembly moves between a first position and a second position based upon oil communicated into the LMR hydraulic assembly from an oil supply channel. The shuttle assembly has a shuttle valve that selectively moves between a closed position and an open position. In the open position, oil flows into the plunger chamber. The rocker arm assembly sequentially moves along a first valve lift profile, a reset valve lift profile and a valve closing profile. In the first valve lift profile, pressurized oil is communicated from the oil supply channel. The shuttle assembly moves into the second position causing the shuttle valve to be opened, the pressure chamber to be pressurized and the plunger to move to the extended rigid position. In the reset valve lift profile, pressurized oil is not communicated from the oil supply channel. The shuttle assembly moves into the first position.

According to additional features, the rocker arm assembly further includes a reset pin that extends from the cylinder head that is moved by the RFF. The reset pin has a connecting channel that selectively aligns with one of an oil supply channel and an oil dump channel at an onset of the reset valve lift profile. Both of the oil supply channel and the oil dump channel defined in the cylinder head. The LMR hydraulic assembly is received in a receiving bore of the cylinder head. A biasing member biases the RFF toward a cam.

The rocker arm assembly can further include a roller bearing positioned generally intermediate the first end of the RFF and the second end of the RFF. A hydraulic lash adjuster (HLA) can be positioned at the first end to accommodate lash between the RFF and a valve. The rocker arm assembly can further provide variable valve assembly functions including engine brake, early exhaust valve opening (EEVO) and late intake valve closing (LIVC). The LMR hydraulic assembly can be in the form of an LMR capsule. The rocker arm assembly can further comprise an accumulator. The hydraulic control element can selectively pass oil to the accumulator.

BRIEF DESCRIPTION OF THE DRAWINGS

The present disclosure will become more fully understood from the detailed description and the accompanying drawings, wherein.

DETAILED DESCRIPTION

Figure 1:
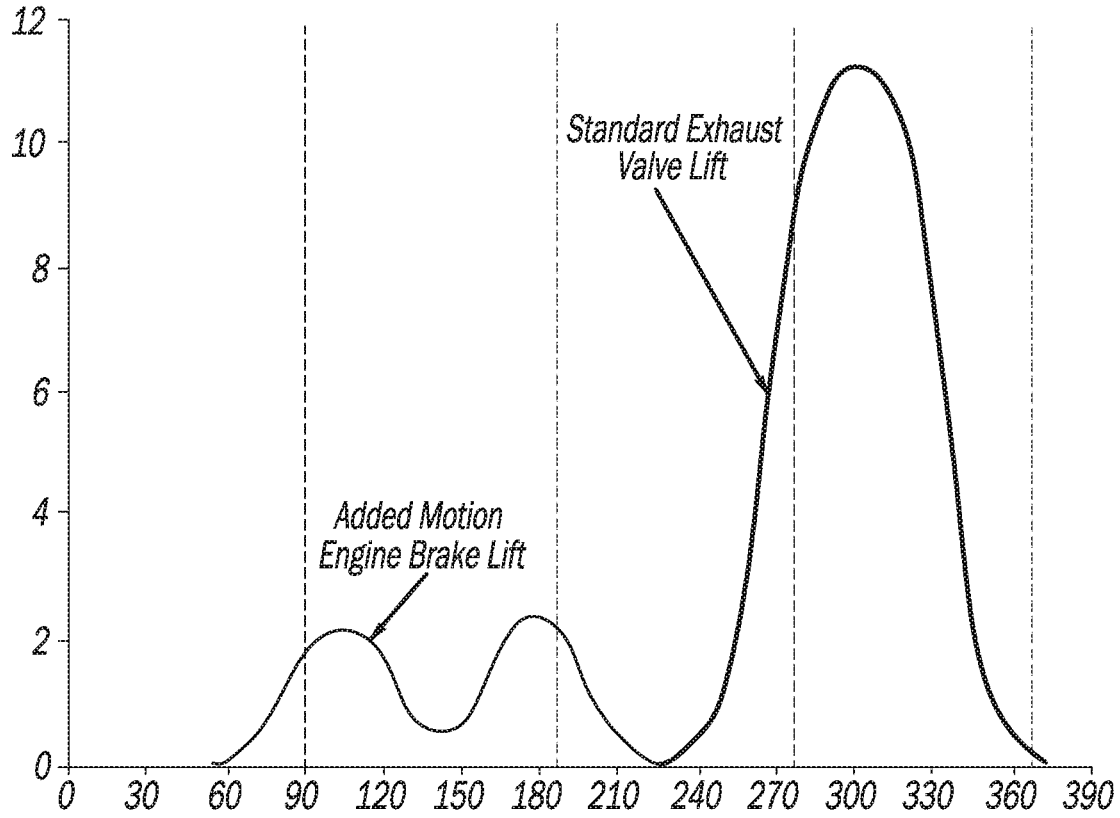
FIG - 1 Prior Art
FIG. 1 is plot showing engine brake lift and standard exhaust valve lift according to prior art.

With initial reference to FIG. 1, a plot according to prior art is shown where standard exhaust lift is identified and an added motion engine brake lift is further identified. A typical system to provide this valve motion uses separate, independent actuation systems for the standard exhaust lift and brake events.

Figure 2:
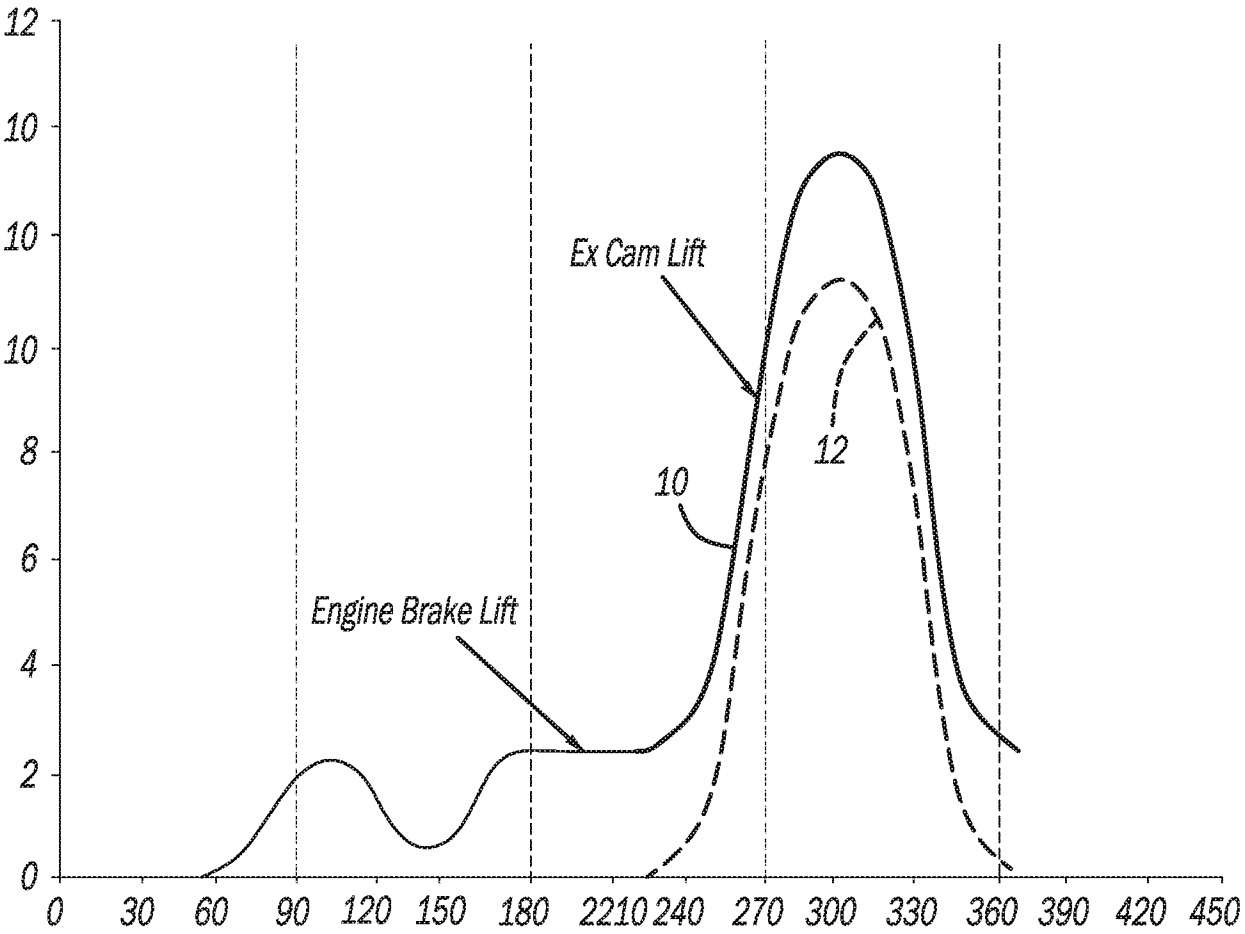
FIG. 2 is a plot showing engine brake lift and exhaust cam lift with a reset function according to one example of the present disclosure.
Figure 3:
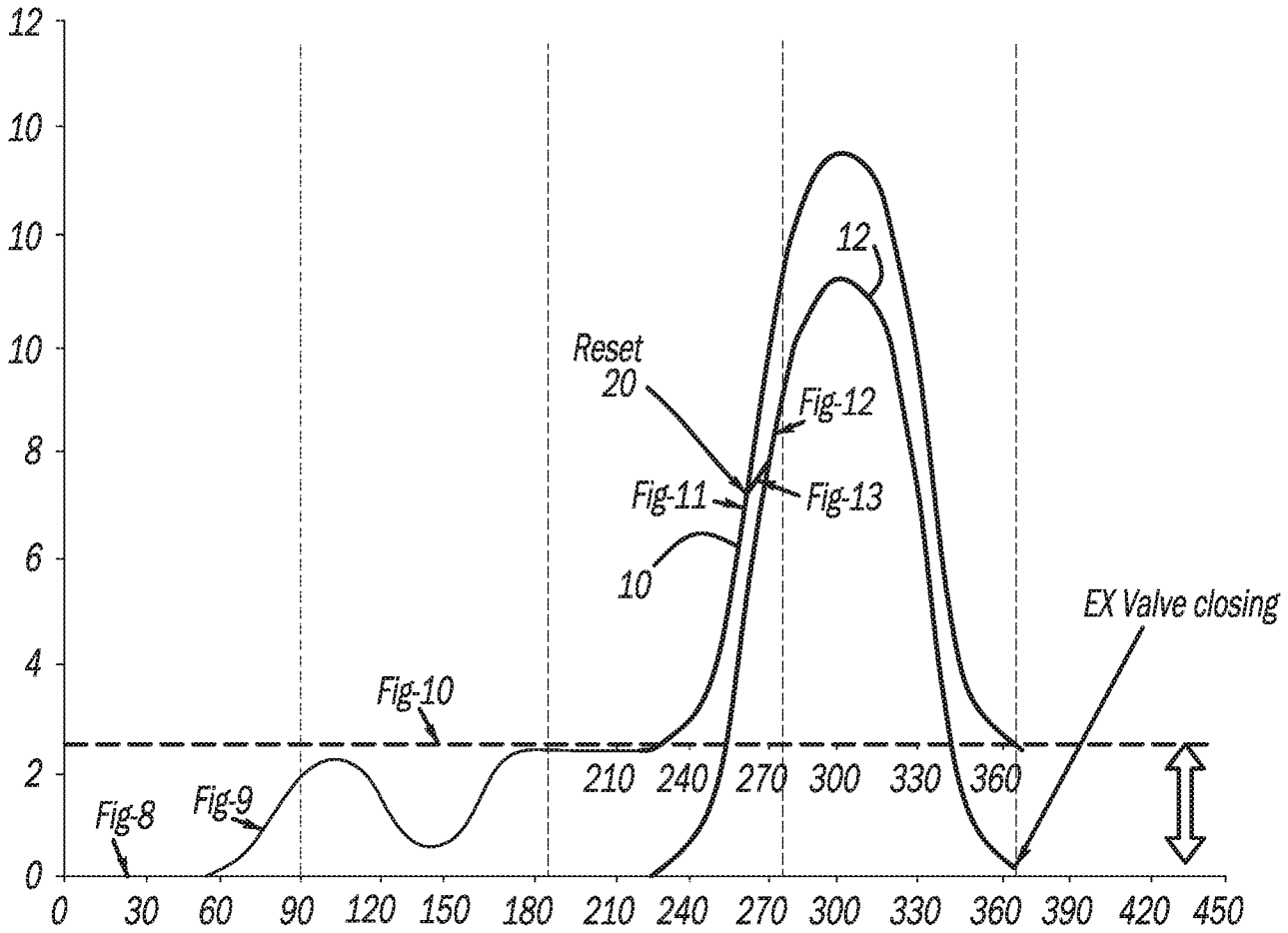
FIG. 3 is another plot showing engine brake lift and exhaust cam lift with a reset function according to one example of the present disclosure.

With reference to FIGS. 2 and 3, a first exhaust profile 10 and a second exhaust profile 12 are shown. The first exhaust profile 10 is associated with engine brake lift. The second exhaust profile 12 is associated with standard exhaust valve lift. According to the present disclosure, while in brake mode, after brake gas recirculation (BGR) and compression release (CR), at a certain point, identified at reset 20 (FIG. 3), a hydraulic capsule will collapse for an amount of lift loss (reset) and the exhaust valve would complete the remainder of the lift as a standard lift. In this regard, the resulting profile will follow the first exhaust profile 10 until the reset 20 where the profile will transition to the second exhaust profile 12.

Figure 4:
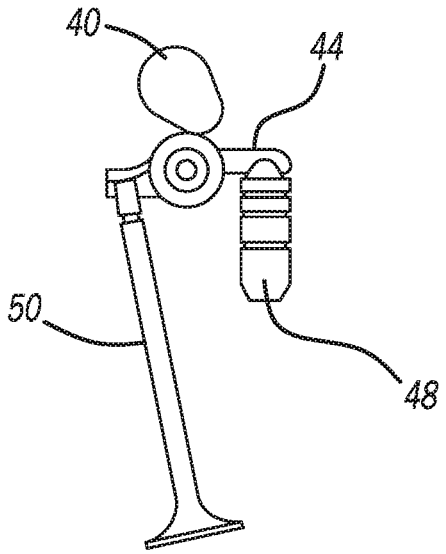
FIG. 4 is a rocker arm configuration for a Type II valvetrain.

With additional reference now to FIG. 4, the present disclosure uses the lost motion with reset principle to create a modular variable valve actuation (VVA) system for a Type II valvetrain. In particular, the present application provides a VVA system for a Diesel engine with a Type II dual overhead cam valvetrain using a lost motion with reset principle to provide VVA functions such as engine brake, early exhaust valve opening (EEVO) and late intake valve closing (LIVC). The system can also incorporate a hydraulic lash adjuster (HLA). In a Type II valvetrain, an overhead cam lobe 40 drives a rocker arm 44. A first end of the rocker arm 44 pivots over a fixed pivot or an HLA 48, while a second end of the rocker arm 44 actuates a valve 50. In a fixed pivot configuration, the end pivot may be a ball and socket configuration or a rocker shaft.

Figure 5:
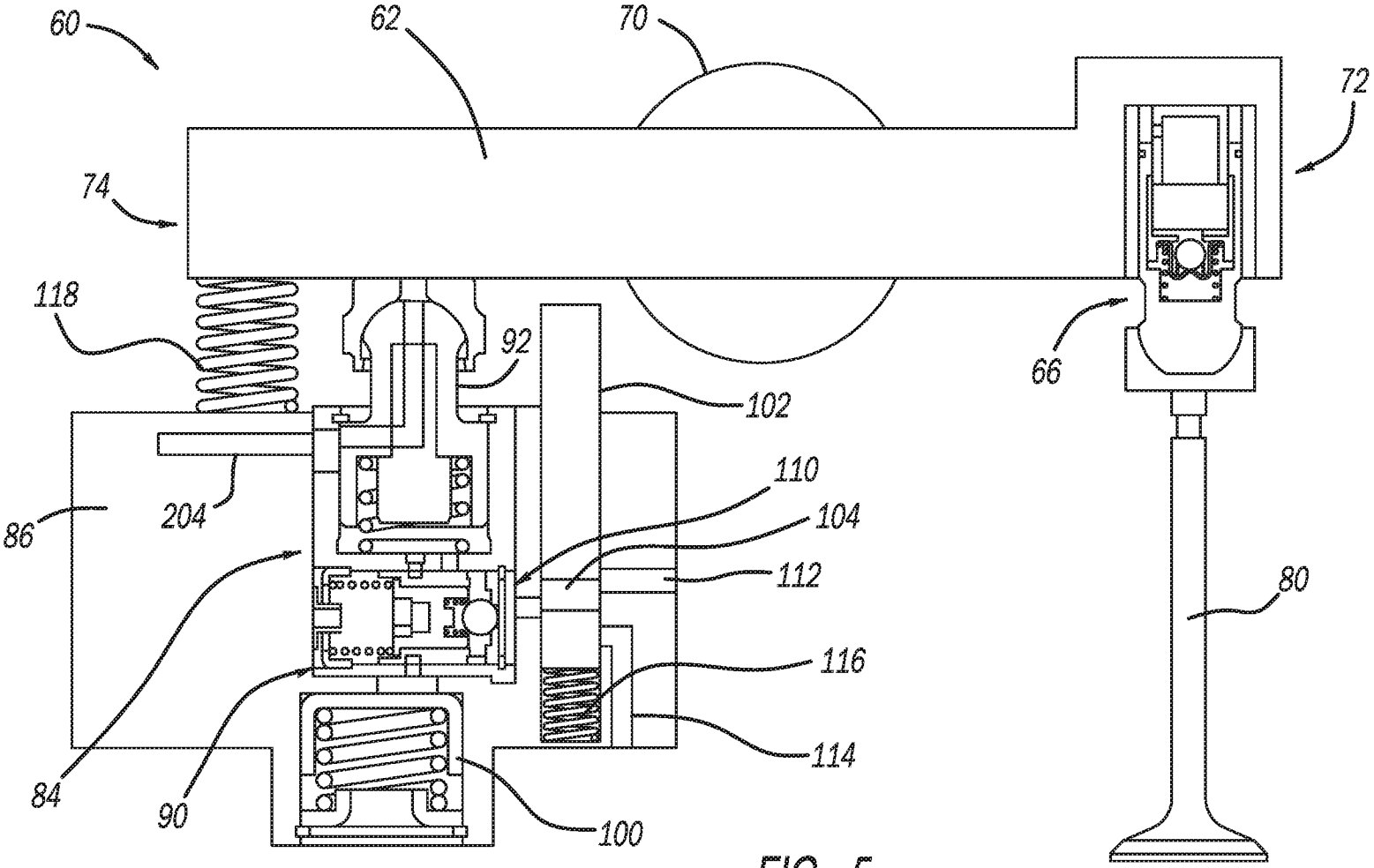
FIG. 5 shows a rocker arm assembly having a lost motion with reset (LMR) hydraulic assembly constructed in accordance to one example of the present disclosure.

With reference now to FIG. 5, a rocker arm assembly according to one example of the present disclosure is shown and generally identified at reference numeral 60. The rocker arm assembly 60 includes a roller finger follower (RFF) 62 that may include an HLA 66. A roller bearing 70 can be positioned generally intermediate a first end 72 of the RFF 62 and a second end 74 of the RFF 62. The roller bearing 70 can cooperate with an overhead cam lobe (see 40, FIG. 5) to transfer motion of the cam to motion of the RFF 62. The HLA 66 can be positioned generally at the first end 72 to accommodate lash between the RFF 62 and a valve 80. The HLA 66 can be located elsewhere in the rocker arm assembly 60. The second end 74 of the RFF 62 can rest on a lost motion with reset (LMR) hydraulic assembly 84.

The LMR hydraulic assembly 84 can be accommodated at a cylinder head 86. Explained further, the LMR hydraulic assembly 84 can be incorporated into or fixed to the cylinder head 86. While the following discussion and related illustrations include an LMR hydraulic assembly 84 in the form of a capsule, the components such as the hydraulic piston, spool valve and accumulator could be individually or collectively separated throughout the cylinder head 86 rather than packaged in a single capsule. The LMR hydraulic assembly 84 includes a hydraulic control element 90 and a plunger 92 with a pivot end. The hydraulic control element 90 can control whether the plunger 92 is hydraulically solid (rigid), or allows the plunger 92 to pass oil to an accumulator 100 in a non-rigid (limp) position. A reset pin 102 having a connecting passage 104 can contact the RFF 62 and control a spool valve (or control plunger) 110 that connects oil volume (control oil feed) 112 to a vented dump 114. Other configurations are contemplated for providing the timing function. For example, any timing element, such as an electronic timing element, that switches the control element 90 from supply to dump is contemplated. A biasing member 116 can bias the reset pin 102 to a position fluidly connected to the control oil feed 112. A biasing member 118 can bias the RFF 62 toward the cam (or a set mechanical lash) and valve contact point. The biasing member 118 can absorb lost motion when the plunger 92 is non-rigid.

Figure 6:
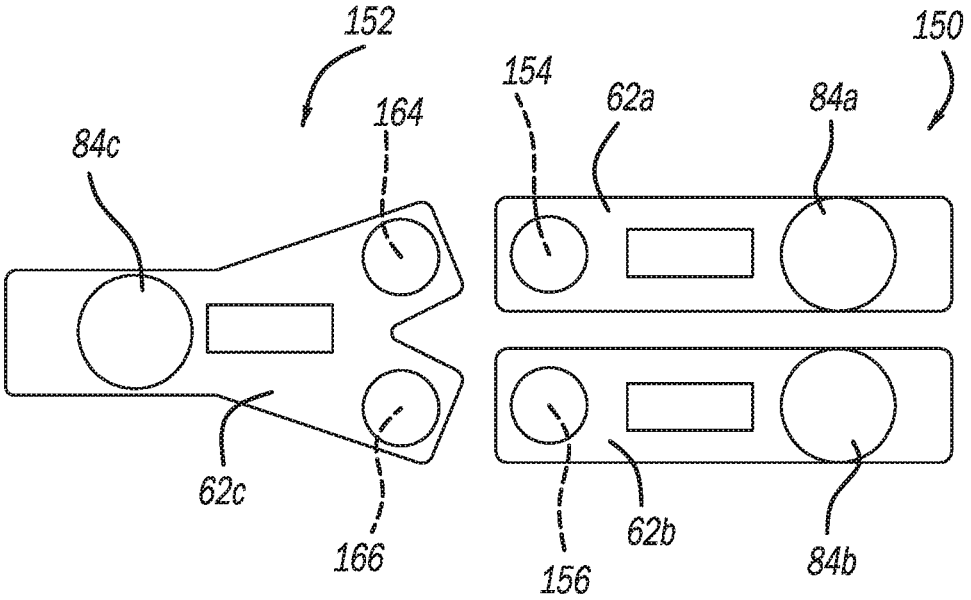
FIG. 6 is an intake and exhaust rocker arm assembly incorporating LMR hydraulic assemblies according to the present disclosure.
Figure 7:
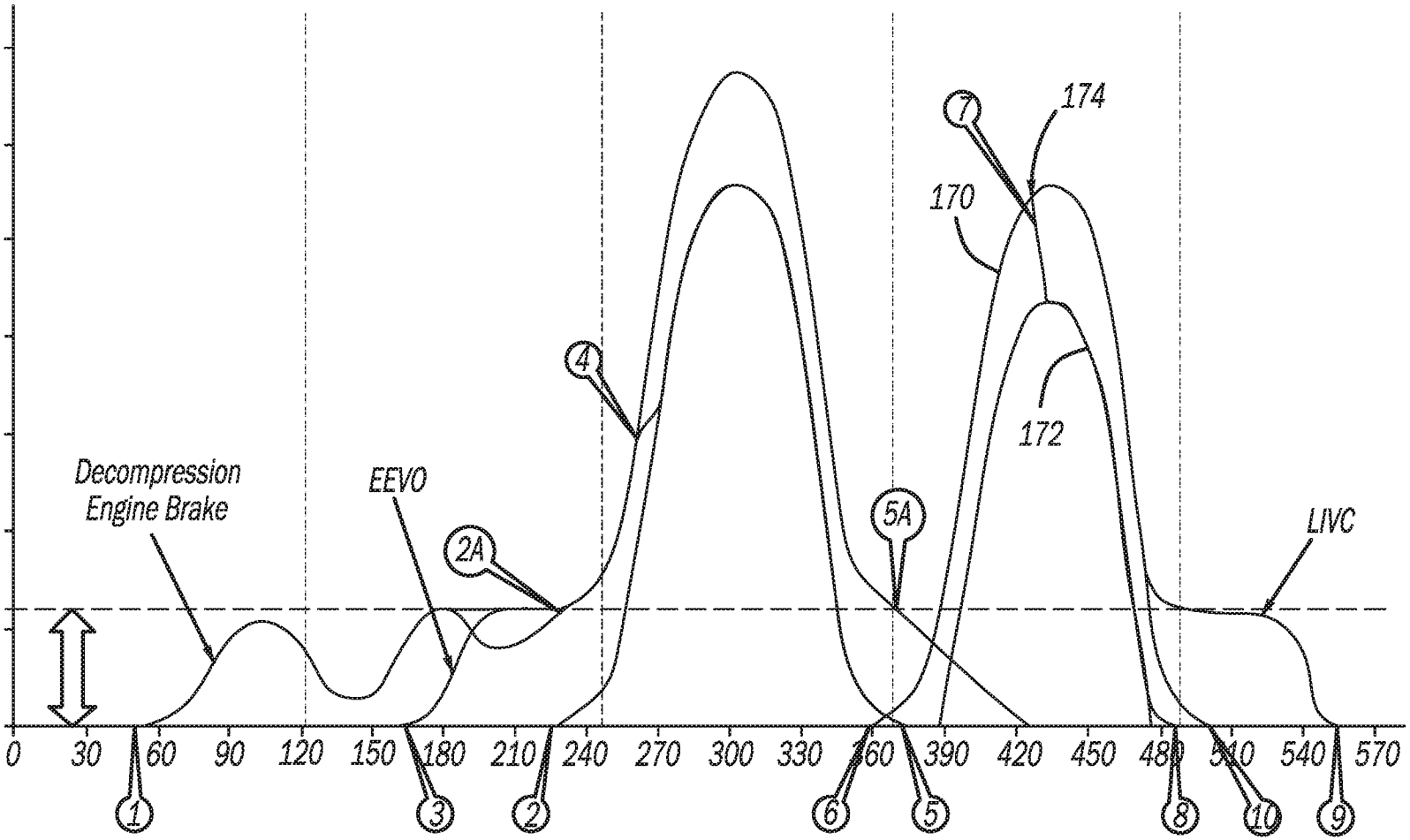
FIG. 7 shows a plot showing intake and exhaust events according to the present disclosure.
Figure 8:
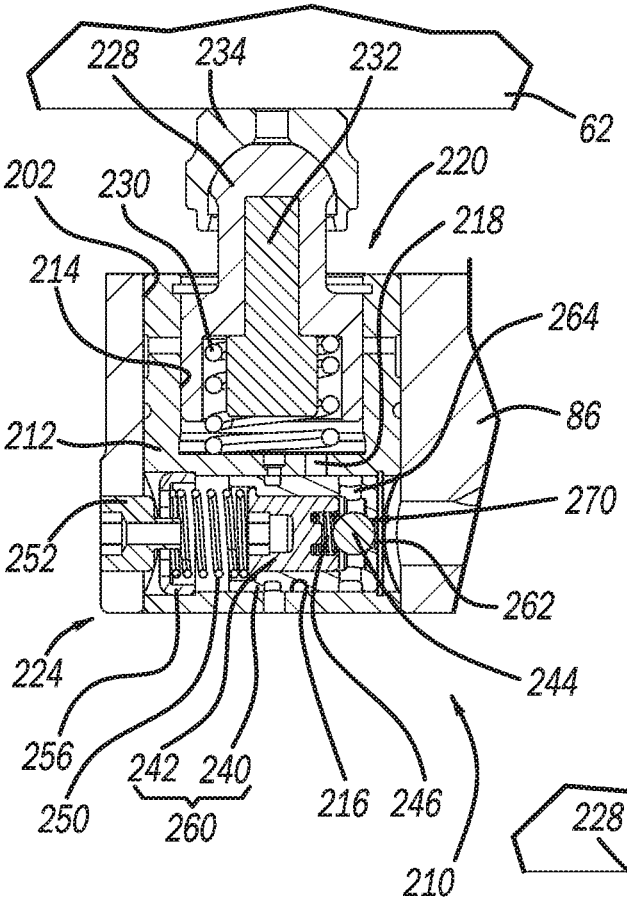
FIG. 8 is a sectional view of the LMR hydraulic assembly constructed in accordance with the present disclosure and shown during a drive mode.
Figure 9:
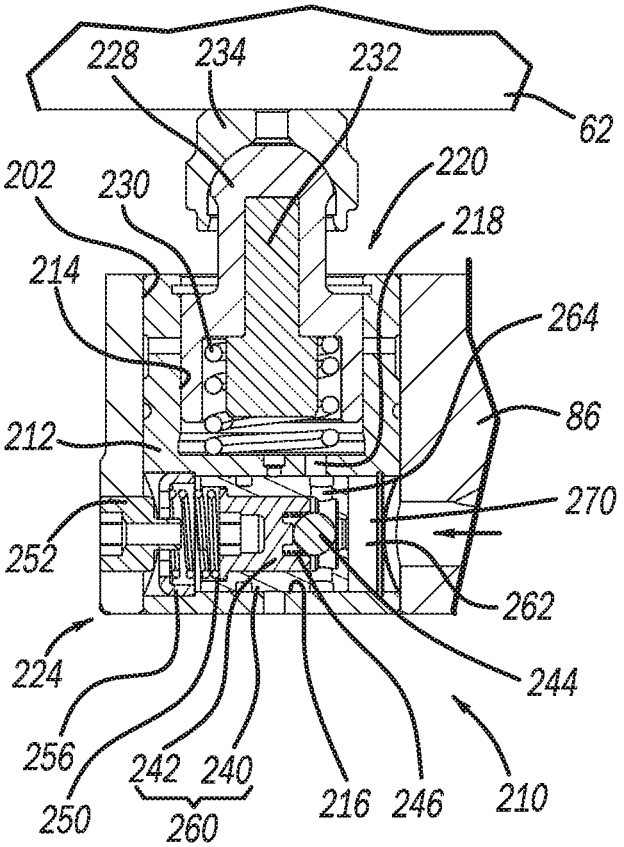
FIG. 9 is a sectional view of the LMR hydraulic assembly constructed in accordance to the present disclosure and shown during engine brake mode.
Figure 10:
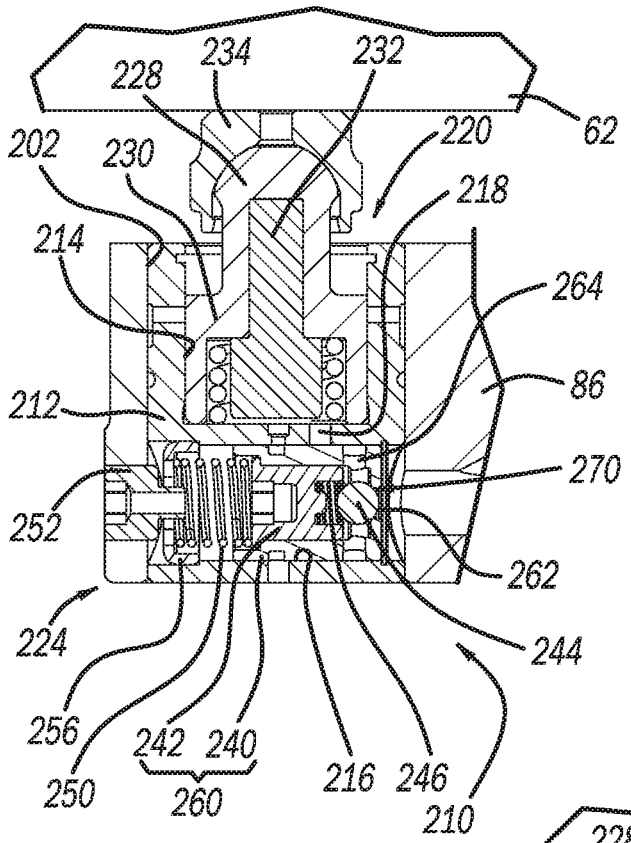
FIG. 10 is a sectional view the LMR hydraulic assembly constructed in accordance to the present disclosure and shown during drive mode with lost motion.
Figure 11:
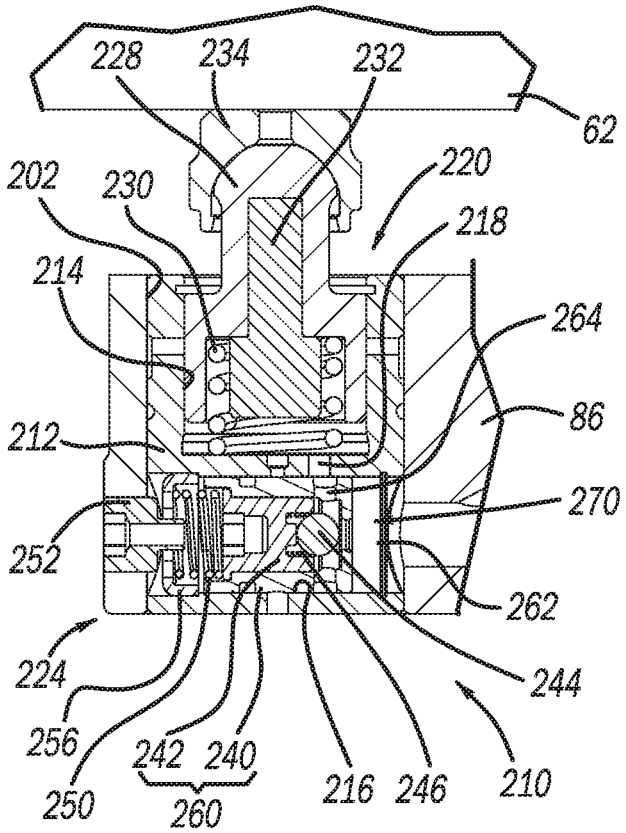
FIG. 11 is a sectional view of the LMR hydraulic assembly constructed in accordance to the present disclosure and shown just before a reset function.
Figure 12:
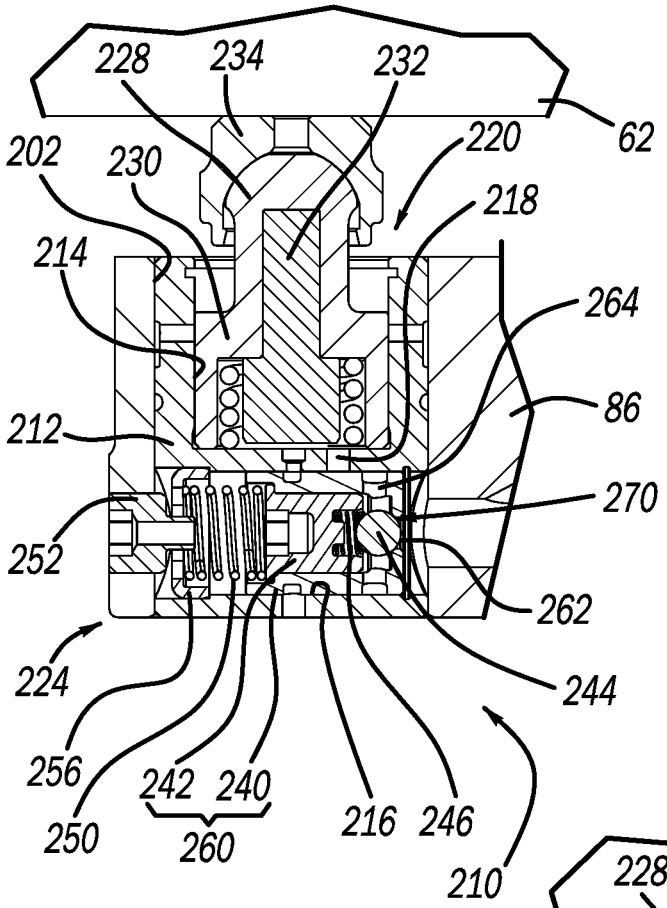
FIG. 12 is a sectional view of the LMR hydraulic assembly constructed in accordance to the present disclosure and shown just after the reset function.
Figure 13:
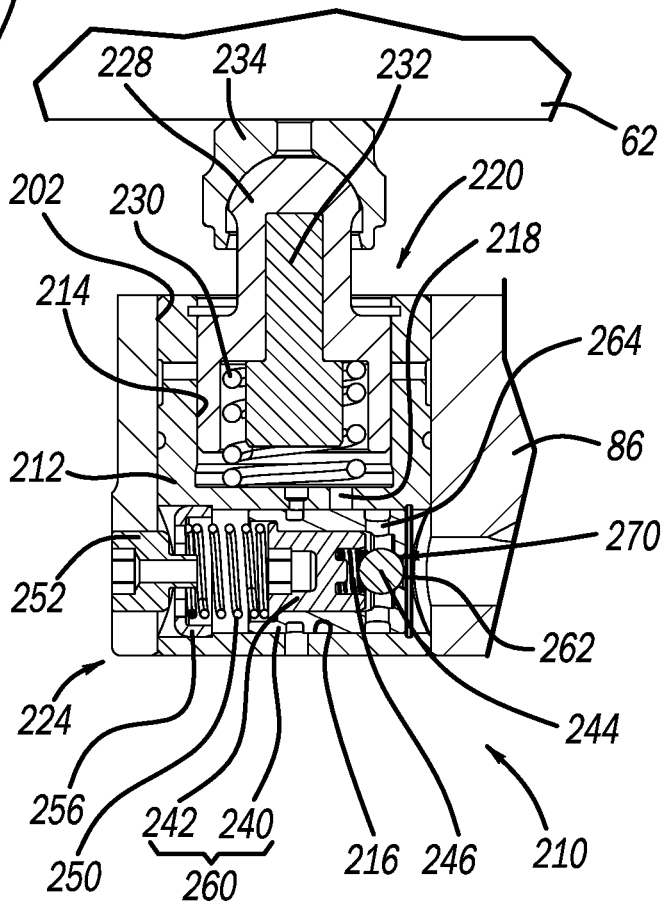
FIG. 13 is a sectional view of the LMR hydraulic assembly constructed in accordance to the present disclosure and shown during the reset function.

Turning now to FIGS. 6 and 7, additional features will be described. A rocker arm configuration can include an exhaust rocker arm assembly 150 and an intake rocker arm assembly 152. The exhaust rocker arm assembly 150 cooperates with exhaust valves 154, 156. The intake rocker arm assembly cooperates with intake valves 164, 166. It will be appreciated that the present teachings may be similarly applicable to other rocker arm configurations. The exhaust rocker arm assembly 150 can include a LMR hydraulic assembly **84*a* for EEVO on a first RFF 62*a* and a LMR hydraulic assembly 84*b* for engine brake on a second RFF 62*b*. The hydraulic assembly 84*a* therefore can be used in a configuration for early exhaust valve opening and the LMR hydraulic assembly 84*b* can be used in a configuration for engine brake. Any combination of capsule configurations may be used. It is further appreciated that one or both of the LMR hydraulic assemblies 84*a* and 84*b* can be arranged in the cylinder head 86** as described above.

On the intake rocker arm assembly 152, a similar configuration can be incorporated. A LMR hydraulic assembly **84*c* is provided on a third RFF 62*c* for LIVC. Very similar hardware can be incorporated on the intake side to achieve further benefit of intake valve closing. In this regard, the same capsule assembly 84 therefore can be incorporated in configurations for engine braking (early exhaust valve opening) as well as late intake valve closing. The capsule assembly 84 can provide hydraulic lash adjustment as well as controlled collapsing used as a reset function. It is further appreciated that the LMR hydraulic assembly 84***c* can be arranged in the cylinder head 86 as described above. The function can be used on both of the exhaust valves for compression brake and on an intake valve for intake valve closing. On the intake rocker arm assembly 152, the lift profile will initially follow a high lift plot 170 and transition to a low lift plot 172 subsequent to a reset event 174. The reset event 174 can occur very close to the maximum lift.

With continued reference to FIG. 5 and additional reference now to FIGS. 8-13, additional features and operation of the LMR hydraulic assembly 84 will be described. The cylinder head 86 defines the oil supply channel 112, the oil dump or relief channel 114, an LMR hydraulic assembly 84 receiving bore 202 and an HLA oil feed 204. As will explained herein, the oil supply channel 112 is caused to supply oil to the LMR hydraulic assembly 84 during a first operating condition while the relief channel 114 is caused to drain oil from the LMR hydraulic assembly 84 based on a position of the reset pin 102.

LMR hydraulic assembly 84 includes a capsule housing 212 received in the receiving bore 202 of the cylinder head 86. The capsule housing 212 defines a plunger chamber 214, a shuttle chamber 216 and a connecting port 218 that connects the plunger chamber 214 and the shuttle chamber 216. The capsule assembly 210 generally includes a plunger assembly 220 and a shuttle assembly 224. The plunger assembly 220 includes a plunger 228, a plunger biasing member 230, a guide rod 232 and an elephant foot 234. The plunger 228 is slidably received in the plunger chamber 214 and biased outwardly by the plunger biasing member 230. As will become appreciated the plunger 228 is caused to be urged outwardly in a rigid position upon accumulation of oil within the plunger chamber 214.

The shuttle assembly 224 can generally include an outer body 240, an inner body 242, a ball 244, a ball biasing member 246, a shuttle biasing member 250, a pin 252 and a cap or closure member 256. The outer and inner body 240 and 242 are collectively referred to herein as a shuttle body 260. The shuttle body 260 can define an upstream shuttle port 262 and a downstream shuttle port 264. The shuttle body 260, ball 244 and ball biasing member 246 can collectively provide a shuttle valve 270 that selectively allows fluid communication in an open position (with the shuttle assembly 224 translated leftward as viewed in the drawings) between the connecting port 218, upstream shuttle port 262 and downstream shuttle port 264.

With reference to FIG. 7, possible valve lift profiles on the exhaust side and intake side for a valve train incorporating rocker arm configurations according to the present disclosure are shown compared to a standard exhaust and intake lift profiles. In the example shown in FIG. 7, the x-axis represents degrees of camshaft rotation and the y-axis represents valve lift. The actual values are merely exemplary. In a standard exhaust lift profile the exhaust valves 154 and 156 open at 2A and close at 5A. In standard intake valve lift, one or both intake valves 164 and 166 open at point 6 and close at point 10.

According to one configuration of the present disclosure, the first RFF 62*a* can be configured for de-compression engine brake. In general, the exhaust valve 154 opens at point 1, goes through exhaust gas recirculation, almost closes, goes through compression release and at point 4, goes through a reset function. Subsequent to the reset function, the exhaust valve 154 follows a standard exhaust valve closing profile and closes at point 5. The second RFF 62*b* can be configured for early exhaust valve opening. In general, the exhaust valve 156 opens at point 3, goes through a reset function at point 4 and follows a standard exhaust valve closing profile and closes at point 5.

In addition, the intake rocker arm assembly 152 can be configured for early intake valve closing where one or both of the intake valves 164 and 166 are opened at point 6, following opening flank travels close to maximum lift where at point 7, goes through a reset function and closes at point 8. Similarly, the intake rocker arm assembly 152 can be configured for late intake valve closing wherein one or both of the intake valves 164 and 166 are opened at point 6 and follow the late intake valve closing cam lift until closing at point 9. It will be appreciated that in some examples a bridge can cause both intake valves 164 and 166 to move concurrently. In other arrangements, dedicated intake rocker arms may be provided to independently operate the first and second intake valves 164 and 166. Other configurations are contemplated. In the example described one oil control valve can be incorporated for delivering oil to the intake valve rocker arm assembly 152.

Turning now to FIGS. 3 and 7-13, operation of the exhaust rocker arm assembly 150 having the reset function in engine brake and drive mode will be described. In drive mode (identified by "FIG. 8" in FIG. 3), the shuttle assembly 224 generally occupies a first position (translated rightward as viewed in FIG. 8) biased by the shuttle biasing member 250. In engine brake mode (identified by "FIG. 9" in FIG. 3), the shuttle assembly 224 translates leftward and occupies a second position. In engine brake mode, pressurized oil is communicated through the oil supply channel 112, causing the shuttle assembly 224 to translate leftward and the shuttle valve 270 to open causing oil to fill the plunger chamber 214 and the plunger 228 to move to an extended rigid position.

In drive mode with lost motion (identified by "FIG. 10" in FIG. 3), the shuttle assembly 224 occupies the first position and the plunger chamber 214 is not pressurized. Therefore, the plunger 228 is permitted to translate against the bias of the plunger biasing member 230.

The reset function will now be described. When the RFF 62*a* continues rotation around the rocker shaft, the reset pin 102 is contacted by the RFF 62*a* and is caused to move its connecting passage 104 from alignment with the oil supply channel 112 to alignment with the oil dump channel 114 (identified by "FIG. 11" in FIG. 3) causing oil to be drained away from the capsule assembly 210. The shuttle assembly 224 is caused to translate rightward, (identified by "FIG. 13" in FIG. 3), from the bias of the shuttle biasing member 250. The plunger 228 is then free to move to a retracted position (plunger chamber 214 is no longer pressurized). In this regard, the lift profile transitions from the solid line to the dashed line (FIG. 3). Upon completion of the reset function, (identified by "FIG. 12" in FIG. 3), the shuttle assembly 224 remains biased rightward by the shuttle biasing member 250 and the valve lift can follow a standard exhaust lift profile. For rocker arms configured for engine brake and early exhaust valve opening, the oil control valve would be upstream of the capsule assembly 210 controlling oil flow into the capsule assembly 210. For early and late intake valve closing, the oil control valve would be downstream controlling oil flow from the capsule.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A rocker arm assembly for a Type II valvetrain arranged for cooperation with a cylinder head, the rocker arm assembly comprising:

a roller finger follower (RFF) having a first end and a second end, the first end cooperating with a valve;

a lost motion with reset (LMR) hydraulic assembly having a hydraulic control element and a plunger, the LMR hydraulic assembly moving the plunger between a rigid position and a non-rigid position, the LMR hydraulic assembly configured at the second end of the RFF, wherein the hydraulic control element further includes a spool valve that connects oil volume to a vented dump; and a reset pin that contacts the RFF and controls the spool valve to connect oil volume to the vented dump.

2. The rocker arm assembly of claim 1, further comprising an accumulator, wherein the hydraulic control element selectively passes oil to the accumulator.

3. The rocker arm assembly of claim 1 wherein a biasing member biases the RFF toward a cam.

4. The rocker arm assembly of claim 1, further comprising a roller bearing positioned generally intermediate the first end of the RFF and the second end of the RFF.

5. The rocker arm assembly of claim 1, further comprising a hydraulic lash adjuster (HLA) positioned at the first end to accommodate lash between the RFF and a valve.

6. The rocker arm assembly of claim 1 wherein the rocker arm assembly provides variable valve assembly functions including engine brake, early exhaust valve opening (EEVO) and late intake valve closing (LIVC).

7. The rocker arm assembly of claim 1 wherein the LMR hydraulic assembly is accommodated in the cylinder head.

8. The rocker arm assembly of claim 1 wherein the LMR hydraulic assembly is in the form of an LMR capsule.

9. The rocker arm assembly of claim 1 wherein the plunger and the spool valve are received in a common receiving bore of the cylinder head.

10. A rocker arm assembly for a Type II valvetrain arranged for cooperation with a cylinder head, the rocker arm assembly comprising:

a roller finger follower (RFF) having a first end and a second end, the first end cooperating with a valve;

a lost motion with reset (LMR) hydraulic assembly configured at the second end of the RFF and disposed in the cylinder head, the LMR hydraulic assembly comprising:

a plunger assembly having a plunger that selectively translates within a plunger chamber between an extended rigid position based upon the plunger chamber being pressurized with oil and a retracted non-rigid position based upon the plunger chamber being depressurized, the plunger moving the engine valve toward an open position; and a shuttle assembly that moves between a first position and a second position based upon oil communicated into the LMR hydraulic assembly from an oil supply channel, the shuttle assembly having a shuttle valve that selectively moves between a closed position and an open position wherein in the open position oil flows into the plunger chamber; and wherein the rocker arm assembly sequentially moves along a (i) a first valve lift profile wherein pressurized oil is communicated from the oil supply channel, the shuttle assembly moving into the second position causing the shuttle valve to be opened, the pressure chamber to be pressurized and the plunger to move to the extended rigid position, (ii) a reset valve lift profile wherein pressurized oil is not communicated from the oil supply channel, the shuttle assembly moving into the first position, and (iii) a valve closing profile.

11. The rocker arm assembly of claim 10, further comprising a reset pin extending from the cylinder head that is moved by the RFF, the reset pin having a connecting channel that selectively aligns with one of an oil supply channel and an oil dump channel at an onset of the reset valve lift profile, both of the oil supply channel and oil dump channel defined in the cylinder head.

12. The rocker arm assembly of claim 10 wherein the (LMR) hydraulic assembly is received in a receiving bore of the cylinder head.

13. The rocker arm assembly of claim 10 wherein a biasing member biases the RFF toward a cam.

14. The rocker arm assembly of claim 10, further comprising a roller bearing positioned generally intermediate the first end of the RFF and the second end of the RFF.

15. The rocker arm assembly of claim 10, further comprising a hydraulic lash adjuster (HLA) positioned at the first end to accommodate lash between the RFF and a valve.

16. The rocker arm assembly of claim 10 wherein the rocker arm assembly provides variable valve assembly functions including engine brake, early exhaust valve opening (EEVO) and late intake valve closing (LIVC).

17. The rocker arm assembly of claim 10 wherein the LMR hydraulic assembly is in the form of an LMR capsule.

18. The rocker arm assembly of claim 10, further comprising an accumulator, wherein the hydraulic control element selectively passes oil to the accumulator.

* * * * *